United States Patent [19]

Kadija

[11] 4,207,163

[45] Jun. 10, 1980

[54] DIAPHRAGMS FOR USE IN THE ELECTROLYSIS OF ALKALI METAL CHLORIDES

[75] Inventor: Igor V. Kadija, Cleveland, Tenn.

[73] Assignee: Olin Corporation, New Haven, Conn.

[21] Appl. No.: 947,235

[22] Filed: Sep. 29, 1978

Related U.S. Application Data

[63] Continuation-in-part of Ser. No. 836,636, Sep. 26, 1977.

[51] Int. Cl.[2] ..... C25B 13/06; C25B 1/46

[52] U.S. Cl. ..... 204/253; 204/252; 204/295; 204/296

[58] Field of Search ..... 204/252, 295, 296

[56] References Cited

U.S. PATENT DOCUMENTS

| | | | |
|---|---|---|---|
| 3,424,659 | 1/1969 | Staal | 204/74 |
| 3,702,267 | 11/1972 | Grot | 429/34 |
| 3,847,762 | 11/1974 | Strain | 204/98 |
| 4,024,036 | 5/1977 | Nakamura et al. | 204/129 |

FOREIGN PATENT DOCUMENTS

| | | | |
|---|---|---|---|
| 47-49424 | 12/1972 | Japan | 204/296 |
| 50-26770 | 3/1975 | Japan | 204/296 |

*Primary Examiner*—F. C. Edmundson

*Attorney, Agent, or Firm*—James B. Haglind; Donald F. Clements

[57] ABSTRACT

A diagraphm for use in the electrolysis of aqueous solutions of ionizable compounds in electrolytic diaphragm cells is comprised of a support fabric impregnated with particles of a siliceous composition having the formula:

$$(X)_m(Si)_p(O)_q(H)_r \cdot nH_2O$$

wherein

X is at least one metal selected from the group consisting of Be, Mg, Ca, Sr, Ba, Ti, Zr, Al, Zn and mixtures thereof;

p is a number from 1 to about 16;

m is zero to about p;

q is a number from 2 to about 5p+r;

r is zero to about 4p; and n is zero to about 30.

The siliceous compositions are capable of undergoing hydration when in contact with at least one of the ionizable compounds in the electrolytic cell.

The diaphragms are physically and chemically stable, provide reduced cell voltages during operation of the cell and have increased operational life.

23 Claims, 9 Drawing Figures

DIAPHRAGMS FOR USE IN THE ELECTROLYSIS OF ALKALI METAL CHLORIDES

This application is a continuation-in-part of co-pending application U.S. Ser. No. 836,636, filed Sept. 26, 1977.

This invention relates to diaphragm-type electrolytic cells for the electrolysis of aqueous solutions of ionizable compounds. More particularly, this invention relates to novel diaphragms for electrolytic diaphragm cells.

In an electrolytic diaphragm cell, the diaphragm represents the cell component which permits the cell to operate by producing, where the electrolyte is an aqueous solution of an ionizable compound, products such as chlorine, alkali metal hydroxide, hydrogen and oxygen at current efficiencies which are high enough to be economically viable. The separation properties, as indicated by the current efficiencies, can be increased by, for example, increasing the thickness or density of the diaphragm. These changes, however, usually result in an increase in the electrical resistance of the diaphragm, as indicated, for example, by an increase in the voltage coefficient. Favorable cell economics depend on increasing or maintaining at a high level the current efficiency while restraining or minimizing the increase in voltage coefficient.

For years commercial diaphragm cells have been used for the production of chlorine and alkali metal hydroxides, hydrogen and oxygen which employed a porous diaphragm of asbestos fibers. In employing asbestos diaphragms, it is thought that the effective diaphragm is a gel layer formed within the asbestos mat. This gel layer is formed by the decomposition of the asbestos fibers in contact with the electrolytes in the cell. When electrolyzing aqueous salt solutions, in addition to undergoing chemical decomposition during operation of the cell, the asbestos fibers also suffer from dimensional instability as they are distorted by dissolution swelling. Porous asbestos diaphragms while satisfactorily producing, for example, chlorine, and alkali metal hydroxide solutions, have limited cell life and once removed from the cell, cannot be re-used. Further, asbestos has now been identified by the Environmental Protection Agency of the U.S. Government as a health hazard.

Therefore there is a need for diaphragms having increased operating life while employing materials which are durable as well as inexpensive.

It is an object of the present invention to provide a diaphragm having increased stability and a longer operational life when employed in the electrolysis of aqueous solutions of ionizable compounds.

Another object of the present invention is the use of ecologically acceptable non-polluting materials in diaphragm compositions.

Yet another object of the present invention is a diaphragm having reduced resistance to electric current.

An additional object of the present invention is a diaphragm having support materials which are chemically and physically stable during electrolysis.

A still further object of the present invention is a diaphragm which can be handled easily during installation in and removal from the electrolytic cell.

These and other objects of the invention are accomplished in a porous diaphragm for an electrolytic cell for the electrolysis of aqueous solutions of ionizable compounds which comprises a support fabric impregnated with particles of a siliceous composition having the formula:

$$(X)_m(Si)_p(O)_q(H)_r \cdot nH_2O \qquad \text{I}$$

wherein

X is at least one metal selected from the group consisting of Be, Mg, Ca, Sr, Ba, Ti, Zr, Al, Zn, and mixtures thereof;

p is a number from 1 to about 16;

m is zero to about p;

q is a number from 2 to about 5p+r;

r is zero to about 4p; and n is zero to about 30, the siliceous compositions being capable of undergoing hydration when in contact with at least one of the ionizable compounds in the electrolytic cell.

Accompanying FIGS. 1–9 illustrate the novel diaphragm of the present invention.

Figure 1:
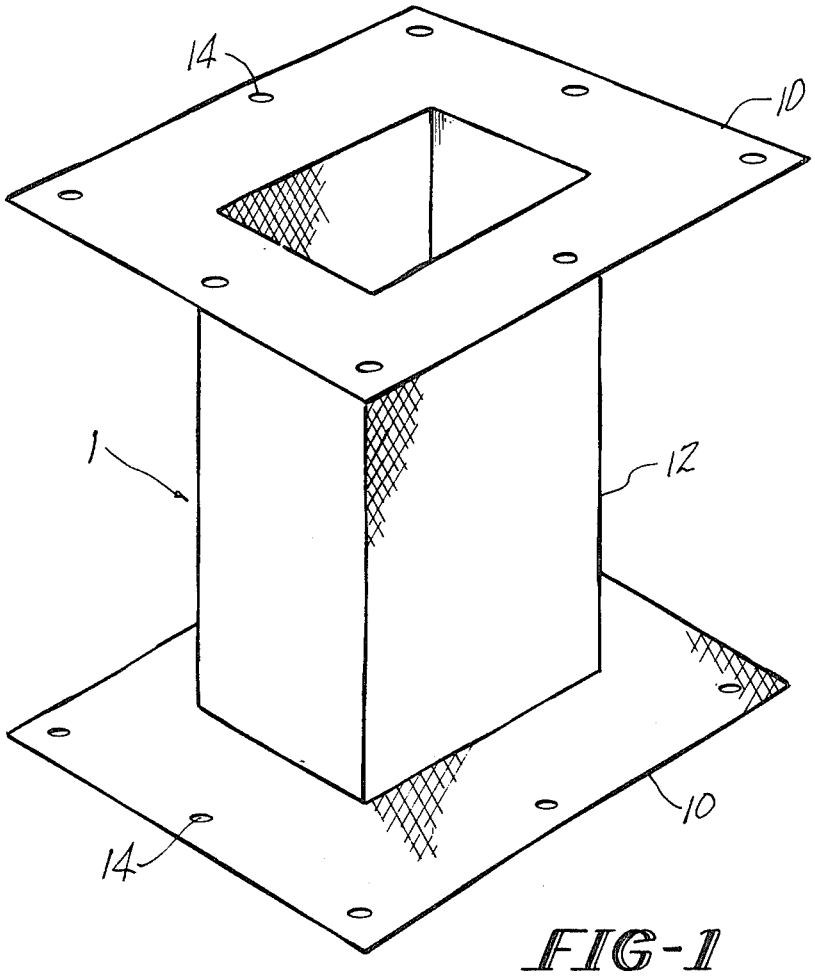
FIG. 1 illustrates a perspective view of one embodiment of the diaphragm of the present invention.

FIG. 1 illustrates a diaphragm of the present invention suitable for covering a cathode. Diaphragm 1, comprised of fabric, has end portions 10 attached, for example, by sewing, to diaphragm body 12. Diaphragm body 12 is a hollow rectangle which is mounted on a cathode (not shown) so that it surrounds the cathode on all sides. End portions 10 have openings 14 which permit end portions 10 to be attached to the cell walls (not shown).

Figure 2:
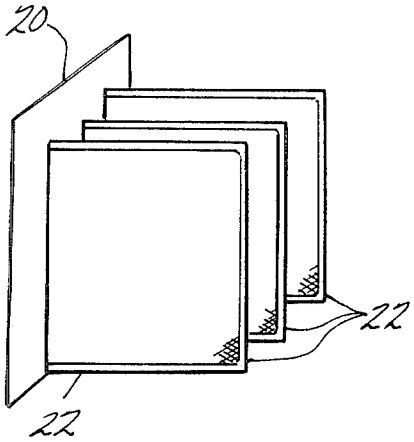
FIG. 2 shows a perspective view of one embodiment of the diaphragm of the present invention suitable for use with a plurality of electrodes.

FIG. 2 depicts a diaphragm suitable for use with a plurality of electrodes. Fabric panel 20 has fabric casings 22 attached substantially perpendicular to the plane of panel 20. Fabric casings 22 are suitably spaced apart from each other and are attached to fabric panel 20, for example, by sewing. Fabric panel 20 has openings (not shown) corresponding to the area where fabric casings 22 are attached to permit the electrodes to be inserted in fabric casings 22.

Figure 3:
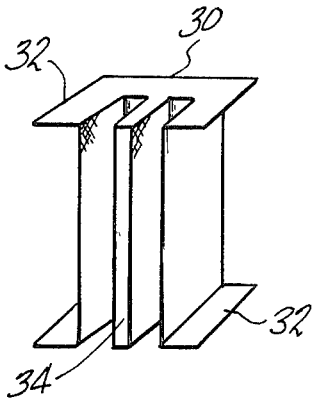
FIG. 3 depicts a perspective view of an additional embodiment of the diaphragm of the present invention for use with a plurality of electrodes.

FIG. 3 illustrates another embodiment of the diaphragm of the present invention. U-shaped fabric panel 30 has end portions 32 for attachment to the cell walls (not shown). Fabric casing 34 is attached to U-shaped fabric panel 30, for example, by sewing. An opening (not shown) at the bottom of fabric casing 34 permits the diaphragm to be installed on a vertically positioned electrode.

Figure 4:
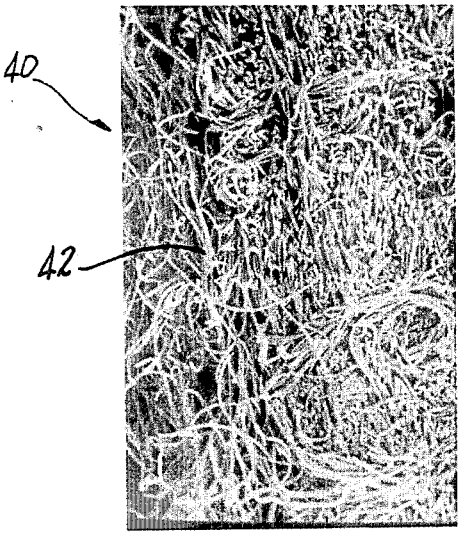
FIG. 4 is a photomicrograph of a cross section of one embodiment of the support fabric employed in the diaphragms of the present invention (magnified 30 times).

FIG. 4 shows a cross section of a polytetrafluoroethylene felt support fabric 40 having fibers 42 randomly oriented.

Figure 5:
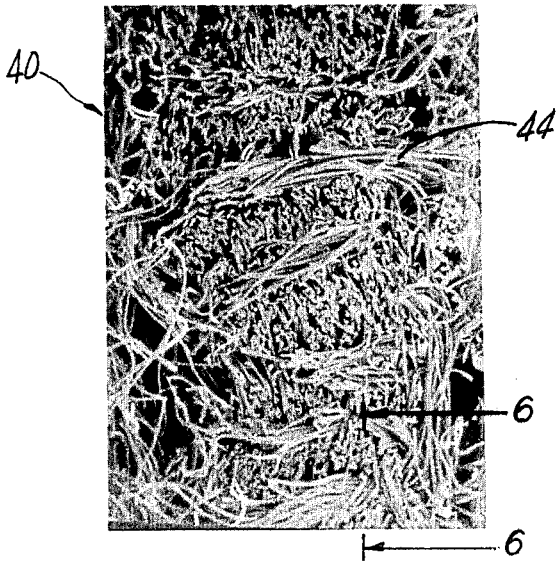
FIG. 5 is a photomicrograph of a planar cross section of an embodiment of the support fabric having fiber bundles (magnified 30 times).

The embodiment of the support fabric 40 illustrated in FIG. 5 has, at regular intervals, fiber bundles 44 which are substantially perpendicular to the plane of the outer surface of fabric 40. Fiber bundles 44 penetrate the entire width of support fabric 40. The support fabric is a polytetrafluoroethylene felt fabric where the magnification shown in the photomicrograph is 30 times the original.

Figure 6:
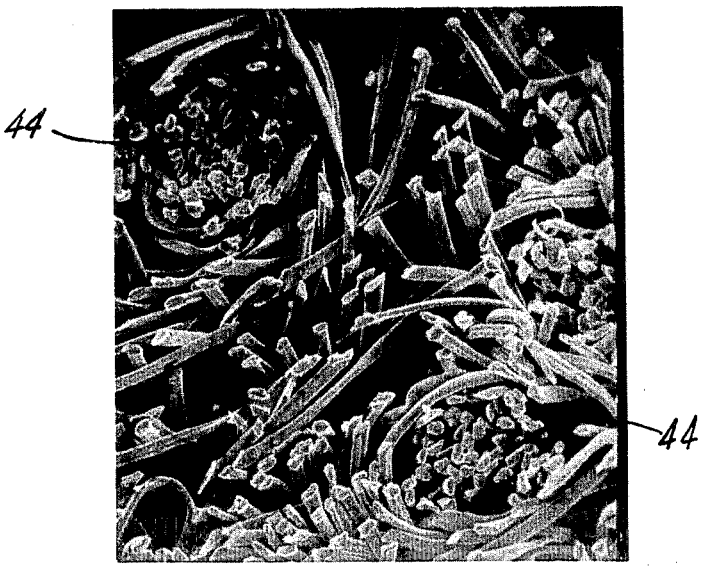
FIG. 6 is a cross section of FIG. 5 taken along line 6—6.

FIG. 6 illustrates fiber bundles 44 found in a cross section of FIG. 5 along line 6—6 where the magnification is 120 times.

Figure 7:
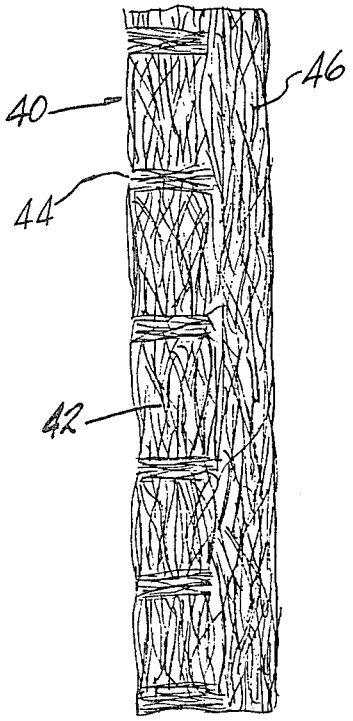
FIGS. 7–9 illustrate a cross section of several embodiments of the support fabric.

Portrayed in FIG. 7 is an embodiment of support fabric 40 in which fiber bundles 44 only partially penetrate the support fabric leaving section 46 having fibers generally oriented in a vertical direction.

Figure 8:
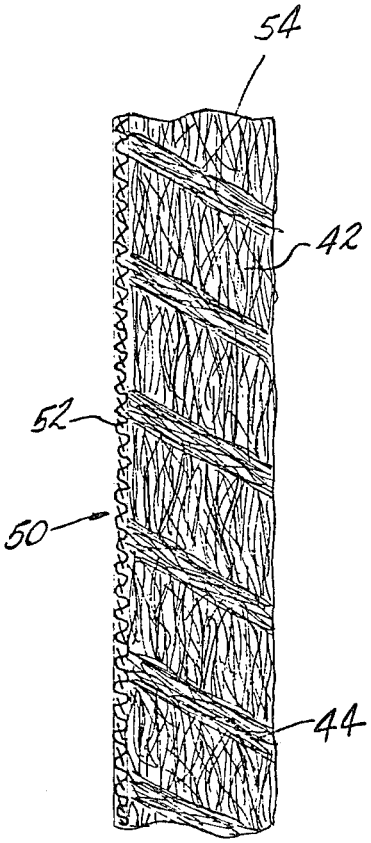

Layered support fabric 50, shown in FIG. 8, has as a first layer 52, a highly porous fabric. Contiguous to first layer 52 is second layer 54 having fiber bundles 44 on a diagonal to the generally vertically oriented fibers 42.

Figure 9:
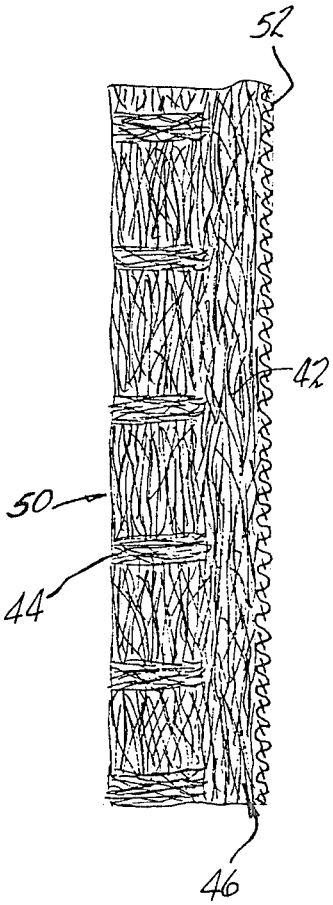

The embodiment of layered support fabrics 50 illustrated in FIG. 9 has first layer 52 of a highly porous fabric non-adjacent to second layer 54. Second layer 54 has fiber bundles 44 partially penetrating second layer 54. Section 46, having fibers generally oriented in a vertical direction is adjacent to first layer 52.

More in detail, the novel diaphragms of the present invention comprise a support fabric which is impregnated with the siliceous composition.

A fabric is employed which is produced from materials which are chemically resistant to and dimensionally stable in the gases and electrolytes present in the electrolytic cell. The fabric support is substantially non-swelling, non-conducting and non-dissolving during operation of the electrolytic cell. The fabric support is also non-rigid and is sufficiently flexible to be shaped to the contour of an electrode if desired.

Suitable fabric supports are those which can be handled easily without suffering physical damage. This includes handling before and after they have been impregnated with the active component. Suitable support fabrics can be removed from the cell following electrolysis, treated or repaired, if necessary, and replaced in the cell for further use without suffering substantial degradation or damage.

Support fabrics having uniform permeability throughout the fabric are quite suitable in diaphragms of the present invention. FIG. 4 illustrates support fabrics of this type. Prior to impregnation with the siliceous composition of Formula I, these support fabrics should have a permeability to gases such as air of, for example, from about 5 to about 500, preferably from about 20 to about 200 and more preferably from about 30 to about 100 cubic feet per minute per square foot of fabric. Uniform permeability throughout the support fabric is not, however, required and it may be advantageous to have a greater permeability in one portion of the support fabric. When impregnated, this portion may be positioned closest to, for example, the anode in the electrolytic cell. Layered structures thus may be employed as support fabrics having, a first layer which when the diaphragm is installed in the cell, will be in contact with the anolyte, and a second layer which will be in contact with the catholyte. The first layer may have, for example, an air permeability of, for example, from about 100 to about 500 cubic feet per minute. The first layer may be, for example, a net having openings which are slightly larger than the particle size of the active ingredient with which it is impregnated.

The second layer, in contact with the catholyte when installed in the cell may, for example, have an air permeability of from about 5 to about 100 cubic feet per minute. For the purpose of using a selected size of active component containing silica, the layered support fabric can be produced by attaching, for example, a net to a felt fabric. The net permits the particles to pass through and these are retained on the felt.

Permeability values for the support fabric may be determined, for example, using American Society for Testing Materials Method D737-75, Standard Test Method for Air Permeability of Textile Fabrics.

The support fabrics may be produced in any suitable manner. Suitable forms are those which promote absorption of the active component including sponge-like fabric forms. Preferred forms of support fabric are felt fabrics, i.e., fabrics having a high degree of interfiber entanglement or interconnection which are usually non-woven. When employing felt as a support fabric, fluids passing through the fabric take a tortuous route through the randomly distributed, highly entangled fibers. The permeability of these fabrics is of a general nature, i.e., non-linear and noncontrolled.

Permeability of these support fabrics may be increased by means which alter the structure of the support fabric. As illustrated in FIGS. 5-9, the support fabrics have been modified by providing means for linear permeability, for example, fiber bundles distributed throughout the support fabric. Spaced apart at regular or irregular intervals, the fiber bundles improve permeability by providing regions through which the flow of fluids such as alkali metal chloride brines is substantially laminar. Laminar flow reduces turbulence or mixing of fluids in the region and results in a homogeneous fluid throughout the region.

To provide fiber bundles in the support fabric, the fabric is, for example, needled or punched at intervals along the surface of the fabric. The depth of the needling may be controlled to provide fiber bundles which penetrate through the fabric, as shown in FIGS. 5-6 and 8, or fiber bundles which only partially penetrate the fabric, as illustrated in FIGS. 7 and 9.

Fiber bundles may be positioned at any suitable angle to the plane of the outer surface of the support fabric. For example, the angle of the fiber bundles may be from about 90 to about 45 degrees from the vertical and preferably from about 90 to about 60 degrees.

Fiber bundles contain a plurality of fibers, for example, up to several hundred fibers may comprise a bundle. The bundles are distributed throughout the support fabric, which may contain several hundred bundles per square inch of fabric.

The fiber bundles provide linear permeability which substantially increases the permeability of the support fabric. Any suitable amount of total permeability of the support fabric may be provided by the inclusion of fiber bundles. For example, fiber bundles may provide from about 15 to about 70 percent of the permeability of the support fabric. Preferably, fiber bundles provide from about 20 to about 50 and more preferably from about 30 to about 40 percent of the permeability of the support fabric.

In addition to improving the permeability, the fiber bundles facilitate the impregnation of the support fabric with the siliceous composition and aid in providing a more uniform distribution of the siliceous composition within the support fabric.

A further advantage of the presence of fiber bundles in the support fabric is that electrical resistance is reduced.

Materials which are suitable for use as support fabrics include thermoplastic materials such as polyolefins which are polymers of olefins having from about 2 to about 6 carbon atoms in the primary chain as well as their chloro- and fluoro- derivatives.

Examples include polyethylene, polypropylene, polybutylene, polypentylene, polyhexylene, polyvinyl chloride, polyvinylidene chloride, polytetrafluroethylene, fluorinated ethylene-propylene (FEP), polychlorotrifluoroethylene, polyvinyl fluoride, polyvinylidene fluoride and copolymers of ethylenechlorotrifluoroethylene.

Preferred olefins include the chloro- and fluoro- derivatives such as polytetrafluoroethylene, fluorinated ethylene-propylene (FEP), polychlorotrifluoroethylene, polyvinyl fluoride, and polyvinylidene fluoride.

Also suitable as support materials are fabrics of polyaromatic compounds such as polyarylene compounds. Polyarylene compounds include polyphenylene, polynaphthylene and polyanthracene derivatives. For example, polyarylene sulfides such as polyphenylene sulfide or polynaphthylene sulfide. Polyarylene sulfides are well known compounds whose preparation and properties are described in the *Encyclopedia of Polymer Science and Technology* (Interscience Publishers) Vol. 10, pages 653–659. In addition to the parent compounds, derivatives having chloro-, fluoro- or alkyl substituents may be used such as poly(perfluorophenylene) sulfide and poly(methylphenylene) sulfide.

Fabrics which are mixtures of fibers of polyolefins and fibers of polyarylene sulfides can be suitably used as well as layered support fabrics in which the first layer is a polyolefin such as polytetrafluoroethylene and the second layer is a polyarylene sulfide such as polyphenylene sulfide.

The support fabric is impregnated with a siliceous composition having the formula:

$$(X)_m(Si)_p(O)_q(H)_r.nH_2O \qquad \text{I}$$

wherein

X is at least one metal selected from the group consisting of Be, Mg, Ca, Sr, Ba, Ti, Zr, Al, Zn, and mixtures thereof;

p is a number from 1 to about 16;

m is zero to about p;

q is a number from 2 to about 5p+r;

r is zero to about 4 p; and n is zero to about 30.

Siliceous compositions of Formula I include those in which m is a positive number and X is at least one metal from Group IIA of the periodic table. Suitable examples are silicates of beryllium, magnesium, calcium, strontium or barium where the ratio of the metal to silicon is no greater than about 1:1. The compositions include magnesium-containing minerals such as sepiolites, meerschaums, augites, talcs and vermiculites; calcium-containing minerals such as wollastonite, as well as minerals such as tremolite having the formula $CaMg_3(SiO_3)_4$. Also suitable are synthetic silicates such as commercial magnesium silicates having the approximate composition $2MgO.3SiO_2.2H_2O$, as well as calcium silicate hydrate having the approximate composition $CaO.3.5SiO_2.1.8H_2O$.

Also suitable are synthetic clay materials which are described, for example, in U.S. Pat. Nos. 3,586,478 and 3,671,190 issued to B. S. Neumann; U.S. Pat. Nos. 4,040,974 and 4,054,537 issued to A. C. Wright et al; U.S. Pat. No. 3,666,407 issued to J. K. Orlemann; U.S. Pat. No. 3,844,979, issued to D. A. Hickson, or U.S. Pat. No. 3,855,147 issued to W. T. Granquist.

Suitable representatives of siliceous compositions of Formula I where the metal is Ti or Zr include zirconium silicates and benitoite ($BaTiSi_3O_9$).

Where X is aluminum, suitable siliceous compositions of Formula I include aluminum silicates, minerals such as alcites, feldspars, labradorites, microclines, nephelines, orthoclases, pyrophyllites, and sodalites; as well as natural and synthetic zeolites.

Synthetic silicate minerals such as those described in U.S. Pat. No. 3,252,757 issued to W. T. Granquist or U.S. Pat. No. 3,252,889 issued to R. G. Capell et al are suitable aluminum-containing compositions.

Also suitable are inorganic compositions in which X is zinc, such as zinc silicates.

Preferred embodiments of siliceous compositions of Formula I are those in which m is a positive number and X is at least one metal selected from the group consisting of Mg, Ca or Al or mixtures thereof, with siliceous compositions of Formula I where X is Mg, Al or mixtures thereof being more preferred. Suitable examples of preferred embodiments include the minerals sepiolites or meerschaums.

Siliceous compositions of Formula I may also include supplementary elements, such as vanadium, niobium, rare earth elements of the lanthanide series, germanium, tin and tungsten. Further, alkali metals such as sodium, potassium and lithium and their oxides are frequently present in siliceous materials suitable as compositions of Formula I. When present in siliceous compositions of Formula I, the above supplementary elements do not represent X and are therefore not included in the determination of m.

In Formula I, where m and r are zero, the siliceous compositions are silica-containing materials which are suitably represented by sand, quartz, silica sand, colloidal silica as well as cristobalite, tripolite and chalcedony. The term "sand" includes compositions having a silicon dioxide content of at least about 95 percent by weight.

As indicated by Formula I, the siliceous compositions may be in the form of a hydrate and various amounts of water of hydration can be present.

Siliceous compositions of Formula I may be formed in situ by the interaction of salts of Be, Mg, Ca, Sr, Ba, Ti, Zr, Al and Zn with, for example, silica or an alkali metal silicate. Where X is magnesium, magnesium compounds such as magnesium acetate, magnesium aluminate, magnesium carbonate, magnesium chloride and magnesium peroxide can be employed. For example, a mixture of the appropriate amounts of magnesia (MgO) with silica in the presence of a cell electrolyte such as an alkali metal hydroxide will produce a siliceous composition of Formula I suitable for use in the porous diaphragm of the present invention.

The presence of metals other than those included in Formula I or discussed above as supplementary elements can be tolerated at low concentrations. For example, the concentration of metals such as Fe, Ni, Pb, Ag as well as other heavy metals which may be present in alkali metal chloride brines suitable for electrolysis are preferably below one part per million. Where these metals are present in minerals suitable as siliceous compositions of Formula I, it is preferred that their concentration be less than about 5 percent of the concentration of silicon present in the material.

Similarly, non-metallic materials such as ammonia as well as organic compounds, if present, should be limited to moderate or preferably low levels of concentration.

The degree to which the siliceous composition of Formula I is hydrated serves as a basis for selecting suitable particle sizes. For those compositions which are readily hydrated in the electrolyte solutions used or produced in the cell, a particle size as large as about 100 microns is satisfactory. Where the component is less easily hydrated, the particle size may be substantially reduced. For these compositions, particles having a size in the range of from about 75 microns to about 0.1 micron are more suitable.

Aqueous solutions of ionizable compounds which are suitable as electrolytes include, for example, alkali metal chlorides and alkali metal hydroxides.

The support fabrics may be impregnated with the siliceous composition of Formula I in any of several ways. For example, a slurry of the composition in a solution such as an alkali metal hydroxide or an alkali metal chloride is prepared and the support fabric is impregnated by soaking in the slurry. Another method is to attach the supporting fabric to the cathode and immerse the cathode in the slurry, using the fabric as a filter cloth. Suction means are employed to draw the slurry through the support fabric where the solid particles impregnate the fabric and the filtrate is withdrawn.

In a further embodiment, the support fabric may be impregnated with the siliceous composition by employing means such as rollers to contact the support fabric with the slurry.

It is not necessary to employ a solution or slurry for impregnation purposes. For example, the inorganic siliceous composition of Formula I may be used to form a fluidized bed. A vacuum is employed to suck the particles into the support fabric until the desired degree of impregnation is obtained.

When impregnated, the novel diaphragm of the present invention contains from about 10 to about 100, preferably from about 25 to about 75, and more preferably from about 30 to about 50 milligrams of the siliceous composition per square centimeter of support fabric.

Following impregnation with the siliceous composition of Formula I, the diaphragms have a permeability to alkali metal chloride brines of from about 100 to about 1000, and preferably from about 200 to about 500 milliliters per minute per square meter of diaphragm at a head level difference between the anolyte and the catholyte of from about 0.1 to about 20 inches of brine.

In order to provide similar brine permeability rates, deposited asbestos fiber diaphragms require a greater density which results in higher electrical resistance as indicated by larger voltage coefficients at comparable operating conditions. The novel diaphragms of the present invention are thus more energy efficient than deposited asbestos diaphragms and provide reduced power costs.

The novel diaphragms of the present invention have handling properties which far exceed those of, for example, asbestos. The supported diaphragms can be removed from the cell, washed or treated to restore flowability and replaced in the cell without physical damage. During operation of the cell, the novel diaphragms remain dimensionally stable with the support material neither swelling nor being dissolved or deteriorated by the electrolyte, the siliceous composition or the cell products produced.

Electrolytic cells in which the diaphragms of the present invention may be used include those which are employed commercially in the production of chlorine and alkali metal hydroxides by the electrolysis of alkali metal chloride brines. Alkali metal chloride brines electrolyzed are aqueous solutions having high concentrations of the alkali metal chlorides. For example, where sodium chloride is the alkali metal chloride, suitable concentrations include brines having from about 200 to about 350, and preferably from about 250 to about 320 grams per liter of NaCl. The cells have an anode assembly containing a plurality of foraminous metal or graphite anodes, a cathode assembly having a plurality of foraminous metal cathodes with the novel diaphragm separating the anodes from the cathodes. Suitable electrolytic cells which utilize the novel diaphragms of the present invention include, for example, those types illustrated by U.S. Pat. Nos. 1,862,244; 2,370,087; 2,987,463; 3,247,090; 3,477,938; 3,493,487; 3,617,461 and 3,642,604.

Diaphragms of the present invention may also be suitably used, for example, in cells which electrolyze alkali metal hydroxides to produce hydrogen and oxygen.

When employed in electrolytic cells, the diaphragms of the present invention are sufficiently flexible so that they may be mounted on or supported by an electrode such as a cathode.

During electrolysis of alkali metal chloride solutions, the siliceous compositions of Formula I produce a gel-like formation which is permeable to alkali metal ions. While the gel-like formations may be produced throughout the diaphragm they are normally produced within the support fabric in the portion which is adjacent to the anolyte side. The extent of gel formation within the support fabric varies, for xample, with the thickness of the support fabric and the concentration of alkali metal hydroxide in the catholyte liquor. Preferred diaphragms are those which have a gel-free portion in contact with the catholyte. Gel formation is believed to occur during hydration of the siliceous composition. The gel is believed to be soluble in the catholyte liquor and it is desirable that the rate of dissolution be controlled to maintain a suitable equilibrium between gel formation and dissolution for efficient operation of the cell. The presence of metals and compounds represented by X in Formula I in the gel is believed to be one way of increasing the stability of the gel and thus reduce its rate of dissolution. Another way appears to be the selection of suitable particle sizes for the inorganic composition. Gel-free portions of the diaphragm are attained, for example, by controlling the areas of the support fabric which are impregnated with the siliceous composition or by controlling the concentration of the electrolytes in the anode and cathode compartments. Efficient cell operation is attained by controlling the equilibrium sufficiently to produce a caustic liquor containing silica in amounts of from about 10 to about 150 parts per million. This may be obtained by periodically adding the inorganic siliceous composition of Formula I to the brine in suitable amounts. Alkali metal chloride brines used in the electrolytic process normally contain concentrations of silica of from about 10 to about 30 parts per million and thus the brine may supply sufficient silica to maintain the equilibrium and supplemental addition of inorganic composition may not be necessary.

The porous diaphragms of the present invention are illustrated by the following examples without any intention of being limited thereby.

EXAMPLE 1

Sepiolite, having particle sizes in the range between 44 microns and less than 1 micron, was added to sodium chloride brine having a concentration of 295–305 grams per liter of NaCl. The sepiolite was dispersed in the brine using a blender until the brine contained about 5 percent by volume of sepiolite. Analysis of the sepiolite indicated oxides of the following elements were present as percent by weight: Si 79.1; Mg 9.3; K 4.8; Ca 4.8; Al 1.4 and Fe 1.4.

A section of polytetrafluoroethylene felt 0.048 inch thick, in the form shown in FIG. 1, was washed in a caustic soda solution containing 15–20 percent NaOH and at a temperature of 30° C. for about 24 hours to remove residues and improve wettability. The felt was then fitted on a steel mesh cathode. The felt had an air permeability in the range of from about 20 to about 70 cubic feet per minute per square foot. The felt-covered cathode was immersed in the brine containing sepiolite and a vacuum applied to impregnate the felt with the dispersion until a vacuum of 23 to 27 inches was reached. The vacuum was shut off and the procedure repeated three times.

The impregnated, felt-covered cathode was installed in an electrolytic cell employing a ruthenium oxide coated titanium mesh anode and sodium chloride brine at a pH of 12, a concentration of 300±5 grams of NaCl per liter and a temperature of 90° C. Current was passed through the brine at a density of 2.0 kiloamps per sqaure meter of anode surface. The initial brine head level was 0.5 to 1 inch greater in the anode compartment than in the cathode compartment. The permeability of the impregnated diaphragm was found to be in the range of from about 200 to about 250 milliliters per square meter of diaphragm by measuring the rate of catholyte liquor produced. After about six days of cell operation, the premixed dispersion of sepiolite in brine was added to the anolyte. The amount added corresponded to about 3 percent of the volume of the anolyte compartment of the cell, the addition being made without interruption of the electrolysis process. After a period of six weeks, the cell voltage began to increase rapidly and current efficiency was reduced. While maintaining the cell in operation, a 5 percent HCl solution was fed to the anolyte compartment and the catholyte liquor was diluted with cold water. Cell performance after treatment of the anolyte and the catholyte was restored to that found earlier, as shown by the results in Table I below.

The catholyte liquor produced had a sodium chloride concentration in the range of 130 to 170 grams per liter.

TABLE I

| Days of Operation | Anolyte Head Level (inches) | Conc. NaOH (GPL) | Cell Voltage (v) | Current Efficiency (%) | Power Consumption (KWH/T $Cl_2$) |
|---|---|---|---|---|---|
| 3 | 4.0 | 128 | 2.86 | 72 | 2720 |
| 6 | 4.5 | 129 | 2.85 | 72 | 2720 |
| 8 | 7.2 | 136.8 | 2.95 | 86 | 2350 |
| 10 | 7.8 | 136 | 2.96 | 85 | 2385 |
| 14 | 7.9 | 140 | 3.00 | 87 | 2360 |
| 18 | 8.0 | 132 | 3.02 | 93 | 2224 |
| 33 | 7.2 | 131.2 | 3.05 | 93 | 2246 |
| 35 | 9.3 | 144.8 | 3.02 | 86 | 2405 |
| 42 | 8.0 | 158.4 | 3.02 | 88 | 2351 |
| 44 | 10.4 | 140.0 | 3.10 | 96 | 2212 |
| 47 | 12.0 | 168.0 | 3.15 | 95 | 2271 |
| 48 | 12.0 | 142.4 | 3.15 | 89 | 2480 |
| 50 | 13.5 | 151.0 | 3.15 | 82 | 2631 |
| 55 | 13.6 | 136.0 | 3.22 | 86 | 2549 |
| 56 | 13.8 | 141.6 | 3.00 | 81 | 2664 |
| 58 | 13.6 | 158.4 | 3.00 | 83 | 2506 |
| 61 | 13.5 | 141.6 | 3.02 | 90 | 2499 |
| 62 | 12.0 | 140.0 | 3.05 | 85 | 2458 |
| 64 | 9.6 | 140.0 | 3.05 | 87 | 2374 |
| 66 | 9.0 | 136.0 | 3.10 | 89 | 2326 |
| 68 | 10.0 | 142.0 | 3.12 | 93 | 2238 |
| 70 | 10.5 | 135.3 | 3.15 | 90 | 2387 |
| 72 | 10.5 | 145.0 | 3.15 | 90 | 2387 |
| 74 | 10.0 | 130.0 | 3.15 | 86 | 2503 |
| 80 | 12.0 | 141.0 | 3.13 | 87 | 2464 |
| 84 | 12.0 | 136.0 | 3.15 | 89 | 2426 |
| 88 | 12.0 | 138.5 | 3.10 | 88 | 2452 |

EXAMPLE 2

The procedure of Example 1 was duplicated using a polypropylene felt having a thickness of 0.18 of an inch. After one week of cell operation a mixture of colloidal silica and magnesium chloride in a 10 percent aqueous solution was prepared. The mixture, containing a weight ratio of silica of $MgCl_2$ of 85:15, was added to the anolyte in an amount corresponding to about 3 percent of the volume of the anolyte compartment. The cell was operated for a period of about 3 weeks at a cell voltage of 3.00–3.10 volts, and produced catholyte liquor containing 122–142 grams per liter of NaOH at a cathode current efficiency of 86–92 percent.

EXAMPLE 3

A mixture of colloidal silica and magnesia in sodium chloride brine, having a concentration of 295–305 grams per liter was prepared. The mixture contained a weight ratio of $SiO_2$ to MgO of 85:15.

A section of polytetrafluoroethylene felt 0.068 of an inch thick was impregnated with this mixture using the procedure of Example 1.

The impregnated diaphragm was installed in a cell similar to that of Example 1 and operated using a brine and conditions identified to those used in Example 1. During 10 days of cell operation, at a current density of 2 kiloamps, the cell voltage was in the range of 2.90–3.08 volts while producing a catholyte liquor having a concentration of 108 to 128 grams per liter of NaOH at a cathode current efficiency of 88–92 percent.

EXAMPLE 4

A porous diaphragm of the type of FIG. 5 was produced from a felt fabric of polyphenylene sulfide (Phillips Petroleum Co. Ryton-PPS). The felt fabric had a density of 0.28 grams per cubic centimeter, a thickness of 0.125 inch and an air permeability of 52 cubic feet per meter. The surface of the fabric was needled to provide several hundred bundles of fibers containing about 100 fibers per bundle per square inch of fabric. The fiber bundles penetrated the entire thickness of the felt fabric and were substantially perpendicular to the plane of the felt surface. This provided the felt fabric with a linear permeability which represented from about 30 to about 35 percent of the total permeability of the fabric. The felt fabric was mounted on a cathode and the cathode immersed in a slurry of sepiolite (30 percent by volume) in saturated sodium chloride brine. A roller was used to apply the slurry and impregnate the fabric with sepiolite. The impregnated felt-covered cathode was installed in the electrolytic cell employed in Example 1 containing sodium chloride brine at a concentration of 300±5 grams of NaCl per liter at a pH of 12. Current was applied at a density of 2.0 kiloamps per square meter of anode surface. Electrolysis was conducted for 8 days during which a cell liquor having a concentration of 120–131 grams per liter of NaOH was produced at a cell voltage of 3.1–3.2 volts. The cathode current efficiency was in the range of 86–98 percent.

EXAMPLE 5

A section of a polyphenylene sulfide web was needled lightly to introduce fiber bundles perpendicular to the plane of the surface of the web. Similarly, a section of polytetrafluoroethylene web was needled to introduce fiber bundles perpendicular to the plane of the surface. The polytetrafluoroethylene web was then placed on top of the polyphenylene web and the polytetrafluoroethylene needled to provide a felt fabric in which bundles of fibers of polytetrafluoroethylene penetrated the entire fabric, the bundles being perpendicular to the outer surface of the felt fabric. The felt produced had a weight ratio of 60 percent polyphenylene sulfide and 40 percent polytetrafluoroethylene. A fabric having a thickness of 0.143 of an inch was produced with an air permeability of 51.5 cubic feet per meter.

EXAMPLE 6

A section of polytetrafluoroethylene felt of the type of FIG. 5 was fitted on a steel mesh cathode and impregnated with a sepiolite slurry (40 percent by volume of sepiolite) in sodium chloride brine. The felt had a thickness of 0.95 of an inch and an air permeability in the range of 42–51 cubic feet per square meter of fabric. Of this permeability, 30 to 35 percent was linear permeability provided by fiber bundles distributed throughout the felt, the bundles being perpendicular to the plane of the outer surface of the felt and penetrating the entire felt thickness. It was estimated that the felt contained 300 to 500 fiber bundles per square inch with each bundle containing from about 100 to about 120 fibers. The felt-covered cathode was installed in an electrolytic cell employing a ruthenium oxide coated titanium mesh anode. The anolyte was a brine containing 300–310 grams per liter of NaCl at a pH of 11 and a temperature of 85°–90° C. The cell was operated for 80 days to produce a caustic liquor containing 116–142 grams per liter of NaOH at cathode current efficiencies in the range of 85–98 percent and a cell voltage of 3.1–3.2 volts.

EXAMPLE 7

Sodium silicate (50 g), 20 g of silica gel and 300 mls. of water admixed in a vessel and the mixture heated to 90°–100° C. Magnesium oxide (5 g) was added and the slurry stirred for one hour. Aluminum chloride (3 g) was dissolved in 50 mls. of water and the solution added to the slurry. The slurry was neutralized with hydrochloric acid to a pH in the range of 5–7. Silica flour (10 g) was added and the slurry stirred for 24 hours. A section of polytetrafluoroethylene felt was fitted on a steel mesh cathode and immersed in the slurry. The felt was impregnated with the slurry by mechanical rolling. The impregnated diaphragm was in an electrolytic cell of the type of Example 1. Saturated sodium chloride brine (300–310 gpl NaCl) was electrolyzed to produce a catholyte liquor containing 105–130 gpl of NaOH. The cell voltage was in the range of 3.05–3.18 volts at a current density of 2.2 kiloamps per square meter. Cathode current efficiency: 78–85 percent.

EXAMPLE 8

A synthetic siliceous clay mineral product (N.L. Industries Barasym ® IBH) having a Mg to Si ratio of 2:8 was added to sodium chloride brine to form a slurry containing 20–30 percent by volume of the mineral product. A polytetrafluoroethylene felt of the type of FIG. 5 was impregnated with the slurry using the procedure of Example 4. Electrolysis in a cell of the type of Example 1 for a period of 10 days produced a catholyte liquor having a concentration of 105–120 gpl of NaOH and a cathode current efficiency of 88–91 percent. Cell voltage, at a current density of 2.33 kiloamps per square meter, was 3.15–3.25 volts.

What is claimed is:

1. In an electrolytic diaphragm cell for the electrolysis of aqueous solutions of ionizable compounds, said cell having an anode assembly containing a plurality of anodes, a cathode assembly having a plurality of cathodes, a diaphragm separating said anode assembly from said cathode assembly, and a cell body housing said anode assembly and said cathode assembly, the improvement which comprises a porous diaphragm comprising a thermoplastic support fabric impregnated with particles of a siliceous composition having the formula:

$$(X)_m(Si)_p(O)_q(H)_r.nH_2O$$

wherein

X is at least one metal selected from the group consisting of Be, Mg, Ca, Sr, Ba, Ti, Zr, Al, Zn and mixtures thereof;

p is a number from 1 to about 16;

m is zero to about p;

q is a number from 2 to about 5p+r;

r is zero to about 4p; and n is zero to about 30;

said siliceous compositions being capable of undergoing hydration when in contact with at least one of said ionizable compounds in said electrolytic cell; said support fabric having means to provide linear permeability to said aqueous solutions.

2. A porous diaphragm for use in the electrolysis of aqueous solutions of ionizable compounds in electrolytic diaphragm cells is comprised of a thermoplastic support fabric impregnated with particles of a siliceous composition having the formula:

$$(X)_m(Si)_p(O)_q(H)_r.nH_2O$$

wherein

X is at least one metal selected from the group consisting of Be, Mg, Ca, Sr, Ba, Ti, Zr, Al, Zn and mixtures thereof;

p is a number from 1 to about 16;

m is zero to about p;

q is a number from 2 to about 5p+r;

r is zero to about 4p; and n is zero to about 30;

said siliceous compositions being capable of undergoing hydration when in contact with at least one of said ionizable compounds in said electrolytic cell; said support fabric having means to provide linear permeability to said aqueous solutions.

3. The porous diaphragm of claim 2 in which X is at least one metal selected from the group consisting of Be, Mg, Ca, Sr, Ba, aluminum and mixtures thereof and m is a positive number.

4. The porous diaphragm of claim 3 in which said siliceous composition is present at a concentration of from about 10 to about 100 milligrams per square centimeter of said support fabric.

5. The porous diaphragm of claim 4 in which said support fabric is a polyolefin selected from the group consisting of olefins having from 2 to about 6 carbon atoms and their chloro- and fluoro- derivatives.

6. The porous diaphragm of claim 5 in which said support fabric is a polyolefin selected from the group consisting of polypropylene, polytetrafluoroethylene, fluorinated ethylene-propylene, polychlorotrifluoroethylene, polyvinyl fluoride and polyvinylidene fluoride.

7. The porous diaphragm of claim 6 in which said support fabric is selected from the group consisting of polytetrafluoroethylene and polyvinylidene fluoride.

8. The porous diaphragm of claim 7 in which X is a metal selected from the group consisting of Mg, Ca, Al and mixtures thereof.

9. The porous diaphragm of claim 8 in which said means to provide linear permeability to said support fabric comprises a plurality of fiber bundles.

10. The porous diaphragm of claim 8 in which said support fabric comprises a first layer and a second layer.

11. The porous diaphragm of claim 10 in which said first layer is a net and said second layer is a felt fabric.

12. The porous diaphragm of claim 10 in which said first layer of said support fabric is selected from the group consisting of polytetrafluoroethylene and polyvinylidene fluoride.

13. The porous diaphragm of claim 12 in which said first layer is a felt fabric.

14. The porous diaphragm of claim 13 in which said second layer is polyphenylene sulfide.

15. The porous diaphragm of claim 14 in which said second layer is a felt fabric.

16. The porous diaphragm of claim 15 in which said siliceous composition is selected from the group consisting of sepiolites and meerschaums.

17. The porous diaphragm of claim 8 in which from about 15 to about 70 percent of the total permeability of the support fabric is linear permeability.

18. The porous diaphragm of claim 17 in which said support fabric is a felt fabric.

19. The porous diaphragm of claim 18 in which said siliceous composition is selected from the group consisting of sepiolites and meerschaums.

20. The porous diaphragm of claim 19 in which the permeability to alkali metal chloride brines is from about 100 to about 1000 milliliters per minute at a head level difference in said cell of from about 0.1 to about 20 inches of said alkali metal chloride brine.

21. The porous diaphragm of claim 7 in which said support fabric is polytetrafluoroethylene.

22. The porous diaphragm of claim 4 in which said support fabric is a polyarylene sulfide selected from the group consisting of polyphenylene sulfide, polynaphthalene sulfide, poly(perfluorophenylene) sulfide, and poly(methylphenylene) sulfide.

23. The porous diaphragm of claim 22 in which said support fabric is polyphenylene sulfide.

* * * * *